US005850704A

United States Patent [19]

Harinen

[11] Patent Number: 5,850,704

[45] Date of Patent: Dec. 22, 1998

[54] ASSEMBLY FOR THE ATTACHMENT OF AN ACCESSORY TO A BOOM OF A WORKING MACHINE

[75] Inventor: Vesa Harinen, Varkaus, Finland

[73] Assignee: Kojex OY, Joroinen, Finland

[21] Appl. No.: 821,580

[22] Filed: Mar. 19, 1997

Related U.S. Application Data

[63] Continuation of PCT/FI95/00468 Sep. 1, 1995 published as WO96/08956A1 Mar. 28, 1996.

[30] Foreign Application Priority Data

Sep. 19, 1994 [FI] Finland ..... 944325

[51] Int. Cl.[6] ..... E02F 3/76

[52] U.S. Cl. ..... 37/468; 37/379; 37/403; 414/723

[58] Field of Search ..... 37/403, 468, 379; 172/253, 272, 274, 788; 414/694, 763

[56] References Cited

U.S. PATENT DOCUMENTS

| | | | |
|---|---|---|---|
| 4,805,927 | 2/1989 | Stephenson et al. . | |
| 5,031,704 | 7/1991 | Fleischer et al. . | |
| 5,082,065 | 1/1992 | Fletcher . | |
| 5,339,907 | 8/1994 | Roth . | |
| 5,467,542 | 11/1995 | Hulden | 172/272 X |
| 5,515,626 | 5/1996 | Hölscher | 37/468 |
| 5,561,926 | 10/1996 | Stratti | 37/468 |
| 5,621,987 | 4/1997 | Pratt et al. | 172/272 X |

FOREIGN PATENT DOCUMENTS

| | | |
|---|---|---|
| 469 772 | 10/1987 | Finland . |
| 35 46078 | 7/1987 | Germany . |
| 462 048 | 10/1968 | Switzerland . |
| 90/03472 | 4/1990 | WIPO . |
| 93/20292 | 10/1993 | WIPO . |

*Primary Examiner*—Michael J. Carone
*Assistant Examiner*—Robert Pezzuto
*Attorney, Agent, or Firm*—Pillsbury Madison & Sutro LLP

[57] ABSTRACT

An assembly for the attachment of an accessory to the boom of a working machine consists of a support block, quick-mounting devices attached to the block for mounting the accessory on the assembly and further on the working machine, a mounting bracket at the other end of the assembly, which mounting bracket consists of mounting devices for mounting the assembly removably on the boom or on the quick-mounting fixture attached to the boom. The support block and mounting bracket are attached to each other pivotally through spindle arms, and a power actuator is provided to swivel the support block and mounting bracket in relation to each other. To further improve the performance of the assembly, the support block consists of a rotating ring attached to the spindle arms, which rotating ring is rotatable in relation to the spindle arms, and further includes a support frame attached to the rotating ring, to which support frame the quick-mounting devices are attached.

1 Claim, 2 Drawing Sheets

ASSEMBLY FOR THE ATTACHMENT OF AN ACCESSORY TO A BOOM OF A WORKING MACHINE

This is a continuation of International Appln. No. PCT/F195/00468 filed Sep. 1, 1995, WO 96/08956A1, Mar. 28, 1996 which designated the U.S.

BACKGROUND OF THE INVENTION

The present invention is directed to an assembly for the attachment of an accessory to the boom of a working machine. The assembly consists of a support block with a quick-mounting device for the attachment of an accessory to the assembly and the working machine, and a mounting bracket at the other end of the assembly with a mounting device for removable mounting of the assembly on the boom or on the quick-mounting fixture attached to the boom. The support block and the mounting bracket can be pivoted on spindle arms by a power actuator.

It is customary to attach various accessories to the boom of working machines so that they can be used for different tasks. These accessories include, for instance, plows, buckets, forklift forks, lifting beams, extension beams, excavation assembly etc. A so called quick-mounting fixture is attached to the boom of a working machine. This fixture enables easy mounting and release of various tools. This kind of a quick-mounting fixture is usually permanently fixed to the boom of a working machine, and releasing it is difficult.

For different tasks, however, different orientations are required from different accessories. When using accessories, it is preferable to be able to turn the accessory in multiple directions in relation to the boom. Prior art assemblies include a tool permanently fixed to turning devices, which are fixed permanently or removably to the boom. With these prior art assemblies, a single-axis swinging motion is achieved but an additional rotations of the accessory to various positions are not possible.

SUMMARY OF THE INVENTION

It is the purpose of the invention to present an assembly for the attachment of an accessory to a working machine, by which the drawbacks of prior art assemblies are eliminated. In particular, it is the purpose of the invention to present an assembly, to which an accessory is attached and which can be turned in a desired direction and in as many ways as possible in relation to the boom and which is easily attached to and removed from the boom. Furthermore, it is the purpose of the invention to present an assembly which is simple in construction.

In the assembly of the invention, a support block consists of a rotating ring attached to the spindle arms, which rotating ring is rotatable around the axis perpendicular to the pivoting axis of the spindle arms. The support block also consists of a support frame attached to the rotating ring, to which support frame a quick-mounting device is attached. The support frame, and the accessory mounted on it, can thus be rotated into a desired position and the task can be performed in a proper angle. The assembly related to the invention, can be directly attached to the boom and can easily be removed according to the task, for instance, when using a different kind of assembly or accessory. The assembly can also easily be mounted on and removed from the quick-mounting fixture attached to the boom. In the embodiments of the invention, various assemblies, according to the invention, can be used on the boom and desired tools can be mounted on the assemblies. The assembly, being turnable and rotatable, enables versatile tasks to be performed by the accessory, even in places not accessible by permanently fixed assemblies, or there is no need to turn the working machine as much at various stages of the task. For example, plowing in various directions can be performed, as well as drilling, without ever having to move the boom or the entire working machine.

According to the invention the rotating ring is preferably rotatable 360° in both directions. This kind of a structure makes it possible to turn the accessory exactly to the correct direction. For example, a hydraulic hammer can be directed exactly to the right spot in the correct angle.

BRIEF DESCRIPTION OF THE DRAWINGS

The invention is further explained with reference to the attached drawings, in which.

DETAILED DESCRIPTION OF THE PREFERRED EMBODIMENT

Figure 1:
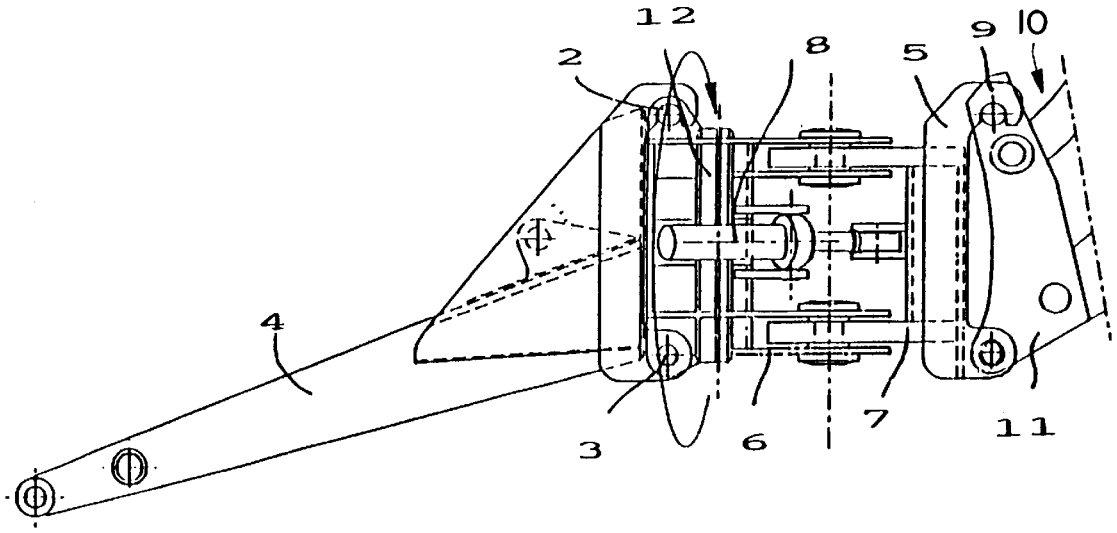
FIG. 1 shows a side view of one embodiment of the assembly of the invention, mounted on a working machine.
Figure 2:
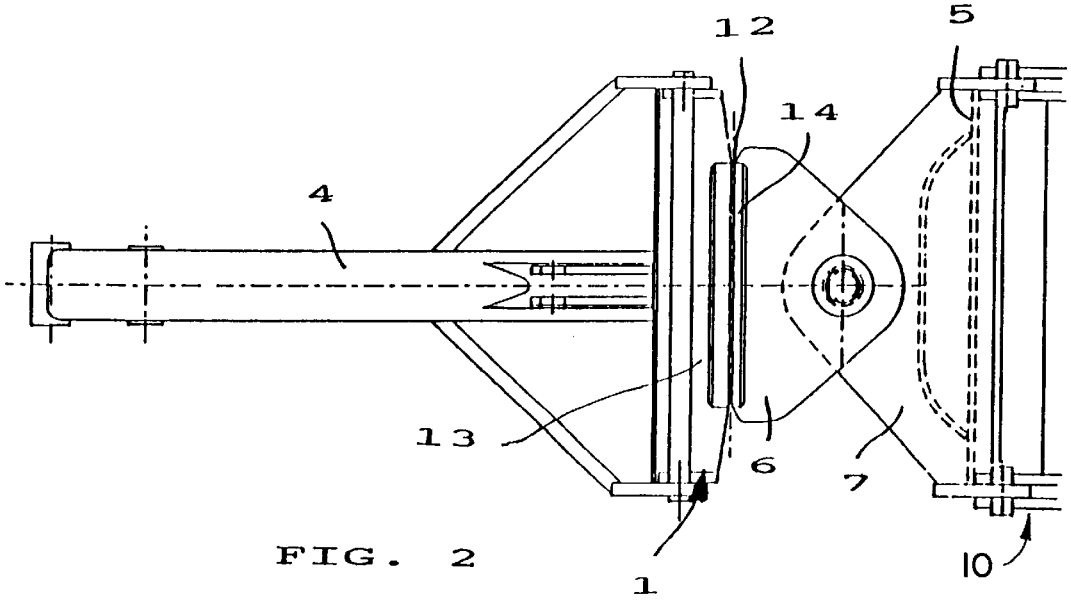
FIG. 2 shows the top view of the assembly of FIG. 1 and, FIG. 3 shows the top view of the assembly of FIG. 1 with the assembly swiveled to the side.
Figure 3:
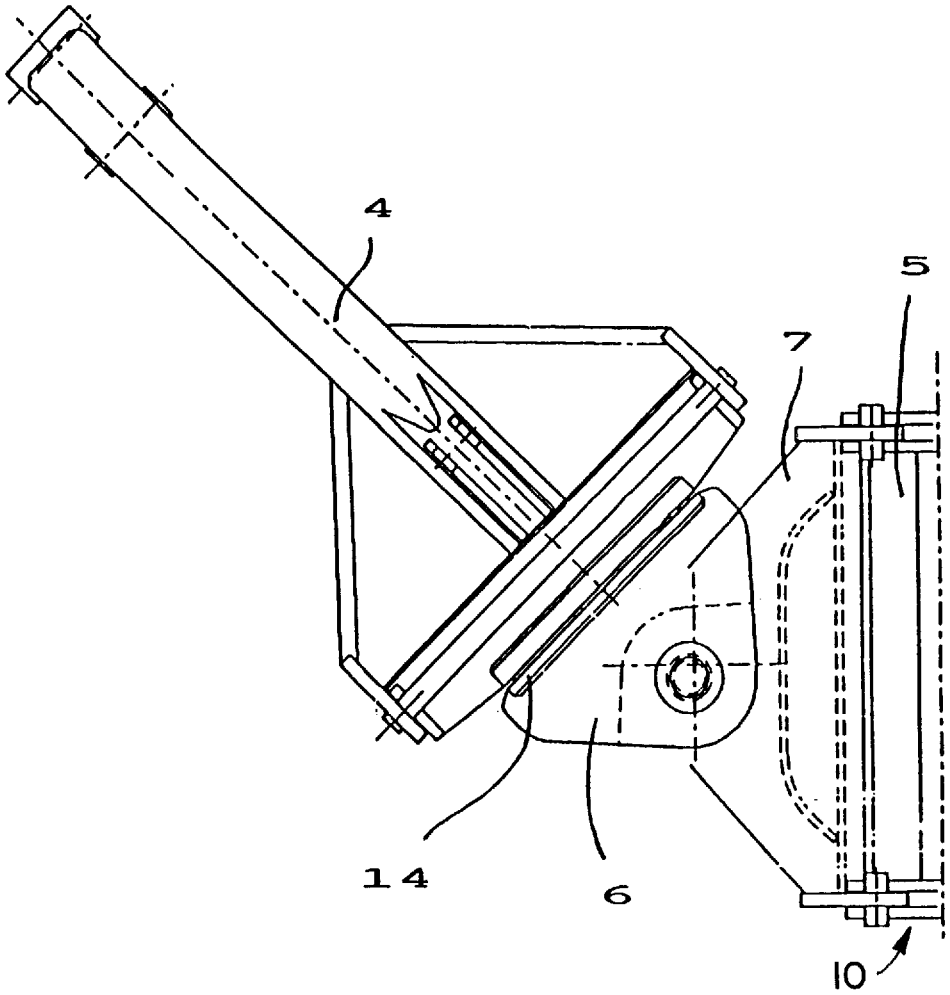

In the embodiments, as shown in FIGS. 1–3, the assembly consists of a support block 1, quick-mounting devices 2 and 3 attached to the support block 1, a mounting bracket 5 at the other end of the assembly, where the support block 1 and the mounting bracket 5 are pivotally attached to each other through the spindle arms 6 and 7, and a actuator 8 to swivel the support block 1 and the mounting bracket 5 in relation to each other. The quick-mounting devices 2 and 3 are commonly known specific quick-mounting devices, by which the accessory 4 can be mounted on the assembly and further on the boom 10 of the working machine. The support block 1 consists of a support frame 13 and a rotating ring 12 attached to the support frame 13. The rotating ring 12 is attached rotatably to the plate 14 which is attached to the spindle arms 6. The rotating rings can be rotated, in this application, around the axis perpendicular to the pivoting axis of the spindle arms 6. The rotating ring 12 can be rotated 360° in both directions. The rotation is accomplished either mechanically or hydraulically.

The mounting bracket 5 consists of the commonly known mounting devices 9 for removably mounting the equipment on the separate quick-mounting fixture 11, attached permanently to the boom of the working machine. The spindle arms 6 and 7, which in this application are like plates, are each attached at one end to the support block 1 and the mounting bracket 5, respectively, and are attached to each other so that they can be swiveled in relation to each other through a pivot or similar structure. The power actuator 8 is a hydraulic cylinder mounted between the support block 1 and the mounting bracket 5 and connected to the hydraulic system of the working machine and can be controlled, for instance, from the cab of the working machine.

The above described preferred device must not be understood to limit the applications of the invention, as the invention can vary within the scope of the annexed claims.

I claim:

1. An assembly for attaching as accessory to a boom of a working machine, said assembly comprising:

a support block;

quick mounting devices attached to said support block for mounting an accessory on the assembly and on the working machine via said assembly;

a mounting bracket at an end of said assembly opposite said support block, said mounting bracket including mounting devices for removably mounting said assembly on a boom or on a quick mounting fixture attached to the boom;

first spindle arms connected to said support block;

second spindle arms connected to said mounting bracket, said first spindle arms being pivotally coupled to said second spindle arms to pivotally couple said support block to said mounting bracket about a first rotation axis;

a hydraulic piston assembly coupled at one portion thereof to said support block and coupled at another portion thereof to said mounting bracket to pivot said support block and said mounting bracket with respect to each other;

said support block comprising:

a support frame to which said quick mounting devices are attached;

a rotating ring attached to said support frame; and a plate to which said rotating ring is rotatably mounted, said plate being attached to said first spindle arms, said rotating ring being rotatable 360° in either of opposite directions with respect to said plate about a second rotation that is generally perpendicular to said first rotation axis.

* * * * *